United States Patent [19]

Van Nederveen

[11] 3,970,517

[45] July 20, 1976

[54] PROCESS OF SAFELY COMPACTING A RADIO-ACTIVE MATERIAL INTO A SOLID BODY

[75] Inventor: Hans Bertil Van Nederveen, Bosch en Duin, Netherlands

[73] Assignee: SKF Industrial Trading and Development Company, B.V., Jutphaas, Netherlands

[22] Filed: Jan. 2, 1974

[21] Appl. No.: 430,011

[30] Foreign Application Priority Data

Jan. 15, 1973 Netherlands ..... 7300552

[52] U.S. Cl. ..... 176/66; 75/226; 176/90; 264/.5

[51] Int. Cl.[2] ..... G21C 3/02

[58] Field of Search ..... 176/89, 66, 67, 90, 176/91 R; 264/.5, 3; 75/226

[56] References Cited

UNITED STATES PATENTS

| | | | |
|---|---|---|---|
| 2,725,288 | 11/1953 | Dodds et al. | 264/.5 X |
| 3,039,944 | 6/1962 | Zumwalt | 264/.5 X |
| 3,344,209 | 9/1967 | Hague et al. | 264/.5 X |
| 3,599,281 | 8/1971 | Boyer | 75/226 X |
| R28,301 | 1/1975 | Havel | 75/226 |

OTHER PUBLICATIONS

Fundamental Principles of Powder Metallurgy by W. D. Jones, Edward Arnold Ltd., 1960, pp. 338–339.

*Primary Examiner*—Stephen C. Bentley
*Assistant Examiner*—Harold Tudor
*Attorney, Agent, or Firm*—Daniel M. Rosen

[57] ABSTRACT

A process for compacting a granular radio-active material into a sealed solid body for use as a heat source, the process carried out in a hot-cell which is partially evacuated.

9 Claims, 1 Drawing Figure

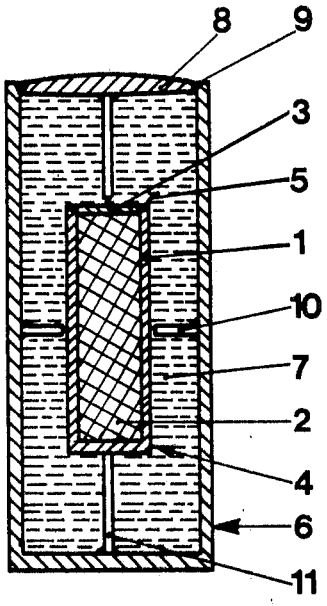
8
9
3
5
1
10
7
2
4
6
11

PROCESS OF SAFELY COMPACTING A RADIO-ACTIVE MATERIAL INTO A SOLID BODY

BACKGROUND OF THE INVENTION

The invention relates to a process of safely compacting a radio-active material into a solid body, said material being presented in a container which is enclosed in a vacuum chamber beforehand, as disclosed in applicant's co-pending U.S. application, having Ser. No. 370,513, filed June 15, 1973.

It is known that the temperature of radio-active materials, emitting radiation energy, increases and that consequently they can be used as isotopic heat sources. Such an isotope is separated, as a rule, from fission products by means of chemical separation processes. The isotope to be separated is then bonded in a specific chemical compound, permitting the practical application of the radio-active isotope. As a rule the final product of the chemical separation processes applied, will be a product of average density, which however, is lower than the theoretical density of the chemical compound.

Beginning with a radio-active material in the form of a granulated or pulverous chemical mass, such mass will be densified for practical purposes to the highest possible degree, by cold and/or hot compacting, and as the case may be, by a subsequent sintering process into bodies which can be easily handled and displaced. It is a well-known fact that the energy-output per unit of volume is in proportion to the number of radio-active atoms per unit of volume. Consequently, in order to realize optimum energy-output, the density of the solid body should approximate as closely as possible, the theoretical density of the selected chemical compound.

SUMMARY OF THE INVENTION

The present improvement provides a process, by which the aforementioned aim can be realized in a safe and economically advantageous manner. For this purpose and as described in the above-mentioned co-pending application within "hot cell", the evacuated compressible container is placed within a second safety-container, whereafter the entire arrangement of containers is compacted. Due to such process the density of the radio-active granulated or pulverous mass will be increased to a density, amounting to more than 95% of the chemical compound's theoretical density.

According to the improvement, the second container constitutes a safety-buffer-element, preventing the spreading of the radio-active material during compacting. It is advantageous to fill up the second container with a high-pressure transmitting medium, preferably composed of a liquid metal; satisfactory results were obtained with liquid lead. It is also preferably to carry out the compacting of the container-arrangement under a pressure of at least 1000 bar and at a temperature above 1200°C for certain period of time.

The improved process will now be described in detail with reference to the drawing, whereby the advantageous and special features of the improvement will become more apparent.

DETAILED DESCRIPTION OF THE PREFERRED EMBODIMENT

The drawing is a schematic representation of a container-arrangement as applied to the process in accordance with this invention. The container arrangement comprises a first container 1, containing a granulated or pulverous radio-active material 2, which has been pre-compacted, in a so-called hot-cell (a space protected against radio-activity, whereby the radio-active material can be handled from outside). At the same time the entire container arrangement and the charge thereof are exposed to mechanical vibrations for a given period of time, thereby already effecting a filling density of 50 – 60 per cent of the pulverous or granulated radio-active material. Such density can most certainly be obtained where the radio-active mass consists essentially of chemical compounds in the form of spherical granules. In this protected space of the hot-cell the container 1 made of a thin metal or plastic such as P.V.C., is closed within a porous cover 3, which then is welded according to the process described in said co-pending applications, preferably applying an electron-beam-welding apparatus comprising a vacuum chamber, wherein the welding of the porous cover 3 to the container-wall 4 can be effected. During this process a uniform welding bead 5 is formed between the cover 3 and the wall 4 in a short time while evacuating the container. Finally a pressure of $10^{-1}$ torr or less is established in the container. The construction of the container 1 differs from the container disclosed in said co-pending application in that filling, pre-compacting, welding and simultaneous evacuation of the container of the present application are carried out in a space, protected against radio-activity, i.e. a hot cell. Thus, by closing the container 1, a body is produced filled with radio-active material within a hot-cell, a fact which is important for reasons of safety, etc.

Next the container 1 is placed, within the aforementioned hot-cell into a second container 6, which is made of a compressible material as well, and filled with a pressure-transmitting medium, e.g. a liquid metal 7. In space the container 6 will be closed by a cover 8 under the same conditions as the container 1, closing being effected by at 9 the cover 8 to the container wall 6, by means of an electron-beam-welding apparatus. To center the container 1 in container 6, easily deformable supporting means 10 and 11 are applied. The container-arrangement 1,6, schematically represented in the drawing, is then compacted in a hydraulic press, the containers being exposed simultaneously to a high pressure and high temperature (hot-compacting process) for a given period of time.

During compacting the second container functions as a safety-buffer-element, thereby preventing the leakage of radio-active material in the course of the hot-compacting process. Should there be leakage, for example, in container 6, i.e., leakage through the container 6 wall, compacting could take place only to a limited extend or not at all, since even a slight pressure-increase is followed by a pressure equalization between the container 6 and the pressure-room of the machine. Upon leakage of the container 1 that contains the radio-active material, liquid metal will seep through the leak into the container 1 during compacting. In this case the final product (the container arrangement or assembly 1,6) will not be compacted, because the pressure-transmitting medium, e.g. liquid metal 7, penetrated the container 1, thereby equalizing pressure.

After-compacting, the compacted radio-active material can be used as an isotopic heat-source by removing the container 1 from the container 6, whereafter the compacted container 1 can easily be handled as an isotopic heat-bar.

I claim:

1. A process carried out in a hot-cell which includes therein a chamber and means for drawing a partial vacuum within said chamber and an electronic-beam welding apparatus, comprising the steps carried out within said chamber and under partial vacuum conditions, of (a) filling a compressible inner container with granulated radio-active material, (b) applying said vacuum pressure to said material within said container, (c) with said welding apparatus, welding a first lid onto said container to seal same against radio-active leakage, and (d) placing said sealed inner container within a compressible outer container with a space defined between said containers and surrounding said inner container, (e) filling said space with liquid metal, and (f) welding a second lid onto said outer container to seal same, thus providing a container assembly and performing compaction on said container assembly, by applying a pressure upon said sealed outer container which being compressible applies pressure onto said liquid metal which transmits said pressure equally in all directions onto said inner container which being compressible compacts said radio-active material therein.

2. A process according to claim 1 wherein said liquid metal comprises lead or a lead compound.

3. A process according to claim 1 wherein said welding apparatus is an electron beam welding apparatus.

4. A process according to claim 1 wherein said compaction on said container assembly comprises applying pressure of at least 1000 bar and simultaneously maintaining said assembly at a temperature of at least 1200°C.

5. In a process of compacting a granular radio-active material into a solid body, where said material is precompacted in a compressible inner container and sealed against radio-active leakage by welding under partial vacuum conditions, the improvement in combination therewith comprising the steps: (a) providing a hot-cell, (b) placing within said hot-cell said inner container, a larger compressible container and lid for same, and welding means operable within partial vacuum conditions, (c) placing said inner container within said outer container, with a space defined between said containers and surrounding said inner container, (d) filling said space with liquid metal, (e) drawing a partial vacuum within said hot-cell and welding said lid on said outer container to seal same, thus providing a container assembly, and comprising the further step of performing compaction on said container assembly, by applying a pressure upon said sealed outer container which being compressible applies said pressure onto said liquid metal which transmits said pressure equally in all directions onto said inner container which being compressible compacts said radio-active material therein.

6. A process according to claim 5 wherein said liquid metal is lead or a lead compound.

7. A process according to claim 5 wherein said compaction on said container assembly comprises applying pressure of at least 1000 bar and simultaneously maintaining said assembly at a temperature of at least 1200°C.

8. A container of radio-active material which material has a theoretical density based upon the chemical compound thereof, and an actual density greater than 95% of said theoretical density made by the process defined in claim 5.

9. A process for compacting a granular radio-active material into a solid isotopic heat source, comprising the steps: (a) filling a compressible inner container with said granular radio-active material, (b) partially evacuating said filler inner container and (c) welding a first lid onto said inner container and thereby sealing same against radio-active leakage, (d) placing said sealed inner container into a compressible larger outer container, with a space defined between said containers, (e) filling said space with a pressure-transmitting medium, (f) welding a second lid onto said outer container and thereby sealing same against leakage of the pressure-transmitting medium, providing a container assembly and also providing a second seal against radio-active leakage from said inner container, (g) performing compaction on said container assembly by applying pressure with a hydraulic press onto said outer container while maintaining said inner container in a heated condition whereby said pressure is transmitted via said compressible outer container into said pressure-transmitting medium and thence into said sealed inner container which being compressible compacts said radio-active material therein.

* * * * *

UNITED STATES PATENT AND TRADEMARK OFFICE

CERTIFICATE OF CORRECTION

PATENT NO. : 3,970,517

DATED : July 20, 1976

INVENTOR(S) : Hans Bertil Van Nederveen

It is certified that error appears in the above-identified patent and that said Letters Patent are hereby corrected as shown below:

Column 1, line 55, delete "preferably" and substitute --preferable--.

Column 2, line 26, after "application" insert -- , --;

line 28, after "application" insert -- , --;

line 37, after "In" insert --this--;

line 39, after "effected by" insert --welding--;

line 54, delete "extend" and substitute --extent--;

line 64, change "After-compacting" to read --After compacting--.

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*